US007883236B2

(12) United States Patent
Vanden Eynden

(10) Patent No.: US 7,883,236 B2
(45) Date of Patent: Feb. 8, 2011

(54) LIGHT FIXTURE AND REFLECTOR ASSEMBLY FOR SAME

(75) Inventor: James G. Vanden Eynden, Hamilton, OH (US)

(73) Assignee: LSI Industries, Inc., Cincinnati, OH (US)

( * ) Notice: Subject to any disclaimer, the term of this patent is extended or adjusted under 35 U.S.C. 154(b) by 254 days.

(21) Appl. No.: 12/027,759

(22) Filed: Feb. 7, 2008

(65) Prior Publication Data

US 2009/0201676 A1 Aug. 13, 2009

(51) Int. Cl.
*F21V 7/05* (2006.01)

(52) U.S. Cl. ..... 362/217.05; 362/225; 362/240; 362/241; 362/297; 362/346

(58) Field of Classification Search ..... 362/225, 362/217.05, 238, 240–241, 260, 614, 297, 362/346

See application file for complete search history.

(56) References Cited

U.S. PATENT DOCUMENTS 2,194,841 A * 3/1940 Welch ..... 362/217.05
2,436,635 A * 2/1948 Bishop, Jr. ..... 362/224
2,619,583 A * 11/1952 Baumgartner ..... 362/221
2,683,799 A * 7/1954 Taylor et al. ..... 362/260
4,336,576 A 6/1982 Crabtree
4,514,793 A 4/1985 Andreasen
4,562,517 A * 12/1985 Pankin ..... 362/147
4,564,888 A 1/1986 Lewin et al.
4,669,033 A 5/1987 Lee
4,719,546 A 1/1988 Spitz
4,796,168 A 1/1989 Peterson
4,928,209 A 5/1990 Rodin
4,933,820 A 6/1990 Engel
5,253,151 A * 10/1993 Mepham et al. ..... 362/216
5,274,533 A * 12/1993 Neary et al. ..... 362/225

(Continued)

FOREIGN PATENT DOCUMENTS

WO WO 8705680 A1 * 9/1987

OTHER PUBLICATIONS

LSI Industries, Inc. "Enclosed & Gasketed-Straight Lens", EG, www.lsi-industries.com (1 page)—first available publicly or published before 2000.

(Continued)

*Primary Examiner*—Ismael Negron
(74) *Attorney, Agent, or Firm*—Nasse & Nesbitt LLC; Daniel F. Nesbitt

(57) ABSTRACT

A light fixture useful in the lighting of parking garages, including a base, a reflector element and at least one light-emitting lamp. The reflector element includes a reflector portion that extends vertical from the base to a distal edge that extends beyond the lamp. The extending reflector portions include a plurality of planer panels positioned in a plane at an angle that faces toward the lamp. A portion of the emitted light is reflected by the extending reflector portion in the opposed horizontal direction away from the fixture at a reflected angle from nadir that is greater than the emitted angle. The light fixture provides a uniform lighting pattern that allows for using fewer of the light fixtures, by projecting or reflecting emitted light horizontally at very high angles from nadir, and delivering more light to areas laterally remote from the fixture, and potentially using less energy.

16 Claims, 8 Drawing Sheets

U.S. PATENT DOCUMENTS

| | | | | |
|---|---|---|---|---|
| 5,521,801 | A | 5/1996 | Pesau et al. | |
| 5,921,666 | A * | 7/1999 | Preston et al. | 362/341 |
| 6,092,913 | A | 7/2000 | Edwards, Jr. | |
| 6,461,023 | B1 * | 10/2002 | McLoughlin et al. | 362/297 |
| 6,523,975 | B1 | 2/2003 | Plourde et al. | |
| 6,578,983 | B2 | 6/2003 | Holten | |
| 6,585,397 | B1 * | 7/2003 | Ebiko | 362/297 |
| 6,942,364 | B1 | 9/2005 | Wegner et al. | |
| 7,029,148 | B2 | 4/2006 | White et al. | |
| 2002/0015312 | A1 * | 2/2002 | Oyama et al. | 362/517 |
| 2005/0213336 | A1 * | 9/2005 | Ford et al. | 362/346 |

OTHER PUBLICATIONS

LSI Industries, Inc. "Enclosed & Gasketed-Angled Lens", EG3, www.lsi-industries.com (1 page)—first available publicly or published before 2003.

LSI Industries, Inc. "Enclosed & Gasketed-Curved Lens", EG4, www.lsi-industries.com (1 page)—first available publicly or published before 2003.

LSI Industries, Inc. "Parabolic for Retail", U.S. Patent No. 7,029,148, www.lsi-industries.com (1 page)—first available publicly or published before 2006.

LSI Industries, Inc. "Linear Fluorescent High Bay", IMX, www.lsi-industries.com (1 page)—first available publicly or published before 2003.

LSI Industries, Inc. "Linear Prismed Acrylic", BR/BRB, www.lsi-industries.com (2 pages)—first available publicly or published before 2000.

LSI Industries, Inc. "Turret Type Center "V" Reflector", F24, www.lsi-industries.com (1 page)—first available publicly or published before 2000.

LSI Industries, Inc. "Wall/Ceiling Mount", W44, www.lsi-industries.com (2 pages)—first available publicly or published before 2000.

Speclight™, "Parking Garage Luminaire", FPG, T5, T5HO, 2005 Acuity Brands Lighting, Inc., www.speclightsolutions.com (2 pages).

Speclight™, "Parking Garage Luminaire", FPG, T8, T5HO, 2005 Acuity Brands Lighting, Inc., www.speclightsolutions.com (2 pages).

Speclight™, "Open Fluorescent High Bay", FIB Induction, 2005 Acuity Brands Lighting, Inc., www.speclightsolutions.com (2 pages).

Speclight™, "Cold Storage Enclosed Fluorescent High Bay", FFB24, T5HO, 2005 Acuity Brands Lighting, Inc., www.speclightsolutions.com (2 pages).

Speclight™, "Fluorescent High Bay", FGB24, T8, 2005 Acuity Brands Lighting, Inc., www.speclightsolutions.com (2 pages).

Speclight™, "Premium Industrial Channel", FPI, T5HO, 2005 Acuity Brands Lighting, Inc., www.speclightsolutions.com (2 pages).

Speclight™, "Medium Unibody Heavy Industrial", FTS, T8, 2005 Acuity Brands Lighting, Inc., www.speclightsolutions.com (2 pages).

Speclight™, "Large Unibody Heavy Industrial", FHI, T5, T5HO, 2005 Acuity Brands Lighting, Inc., www.speclightsolutions.com (2 pages).

* cited by examiner

Conventional EG

EG-30

(each square is 10 feet x 10 feet)

Conventional EG

EG-30

LIGHT FIXTURE AND REFLECTOR ASSEMBLY FOR SAME

BACKGROUND OF THE INVENTION

The present invention generally relates to light fixtures for illuminating architectural spaces. The invention has particular application in light fixtures using fluorescent lamps, such as the T5 linear fluorescent lamp, as the light source.

Numerous light fixtures for architectural lighting applications are known. In conventional parking garages and lots, low wattage high intensity discharge (HID) light fixtures and lamps have been the norm. However, energy consumption, performance and fixture costs have identified a need for improved lighting fixtures and performance in this usage, to obtain the required lighting levels with fewer fixtures.

Another light fixture presently used in a typical parking lot and warehouse environment comprises a troffer with at least one fluorescent lamp and a translucent lens shielding the lamp. The troffer includes an elongated fixture support, a pair of sockets at opposite ends to secure and provide power to the fluorescent lamp. The elongated lamp is typically oriented horizontally with the roadway or lighted surface below. The light fixture is thus intended to distribute emitted light to a wide area. However, since the fluorescent lamps distribute light radially, the illuminance that strikes at the floor or ground directly below the fixture is significantly higher than at an area more laterally remote from the light fixture. The area directly below the light fixture is generally considered at or near nadir, while the area laterally remote from the light fixture is disposed at higher angles from nadir. That is, the amount of light striking a unit area (e.g., lux=lumen/$m^2$) decreases proportionally to its distance from an area directly below the fixture. This can result in uneven lighting, and areas of significantly less lighting remote from the light fixture or at an area between adjacent light fixtures.

An important factor in the design of light fixtures for a particular application is the type of light source. The fluorescent lamp has long been the light source of choice among lighting designers in many commercial applications, particularly for indoor office lighting. For many years the most common fluorescent lamps for use in indoor lighting have been the linear T8 (1 inch diameter) and the T12 (1½ inch diameter). More recently, however, smaller diameter fluorescent lamps have become available, which provide a high lumen output from a comparatively small lamp envelope. An example is the linear T5 (⅝ inch diameter) lamp manufactured by Osram/Sylvania and others. The T5 has a number of advantages over the T8 and T12, including the design of light fixtures that provide a high lumen output with fewer lamps, which reduces lamp disposal requirements and has the potential for reducing overall costs and energy consumption. The smaller-diameter T5 lamps also permit the design of smaller light fixtures.

Nevertheless, there remains a need and opportunity to provide a durable light fixture for certain architectural lighting spaces that distributes a greater amount of light at areas more remote from the area directly below the fixture, with fewer or a minimum number of light fixtures, and with less energy consumption.

SUMMARY OF THE INVENTION

The present invention relates to a light fixture, or troffer, for efficiently distributing light emitted by a light source into an area to be illuminated. The light fixture can provide a more uniform lighting pattern, and allow for use of fewer of the light fixtures, by projecting or reflecting more of the radially emitted light from the lamp into a horizontal direction at higher angles from nadir, and toward the areas laterally remote from the light fixture.

In one aspect of the invention, the light fixture includes a housing, a reflector element and a lamp that emits light having a longitudinal axis in a horizontal plane, wherein the reflector element is configured to receive a portion of the light that is emitted in a first horizontal direction at an emitted angle from a vertical direction, and to reflect the portion of light in an opposite second horizontal direction, away from the light fixture, and at a reflected angle from vertical that is greater than the emitted angle, and toward an area more remote from the light fixture.

In another aspect, the reflector elements include an extending reflector portion that depends vertically below the position of the lamp, and which is configured with a reflective surface having at least a portion which is angled toward the lamp. The surface can be either planar panels or portions, or a curved (parabolic, elliptical, or other) surface. The portion of the reflective surface angled toward the lamp has a planar surface or a curved surface with a tangent that is angled toward normal with the radially-emitted light from the lamp.

In another aspect, the light fixture including the extending reflector portion is configured to receive a portion of the light that is emitted toward the extending reflector portion at an emitted angle from nadir, and to reflect the portion of light in an opposite horizontal direction at a reflected angle from nadir that is greater than the emitted angle, toward an area laterally remote from the fixture.

In another aspect, the light fixture includes a reflector element configured to receive a portion of the light that is emitted toward the light fixture at an emitted angle from nadir, and to reflect the portion of light in a horizontal direction at a reflected angle from nadir that is greater than the emitted angle, toward an area laterally remote from the fixture.

In another aspect of the invention, the light fixture further comprises a second reflector element and a second lamp, wherein the first and second reflector elements are associated to form a reflector assembly, and wherein the reflector assembly is disposed between the two lamps. The reflector assembly is configured to receive light that is emitted from one lamp toward the reflector surface disposed between the two lamps, and to reflect the incident light away from the reflector to an area laterally remote from the light fixture. In another aspect of the invention, the reflector increases the amount of light emitted and reflected to the areas below and laterally remote from the light fixture.

The present invention relates to a light fixture including a housing having an elongated axis in a horizontal plane, the housing including an elongated support means having at least one side edge; an elongated reflector element having a proximal end affixed to the support means, an extending reflector portion extending from the proximal end in a first vertical direction normal to the horizontal plane to a distal edge, the extending reflector portion having at least one specular reflective surface; and an elongated lamp disposed proximate the support means between the extending reflector portion and the at least one side edge, the lamp connectable to a socket means in electrical connection with an electrical power source; wherein the distal edge of the extending reflector portion extends vertically beyond the lamp, whereby a portion of the light emitted by the lamp in a first horizontal direction toward the at least one specular reflective surface is reflected in an opposite second horizontal direction.

In an aspect of the invention, the extending reflector portion includes a plurality of elongated panels, joined along one or more fold lines, wherein each of the plurality of adjoining panels is positioned in a plane at an angle relative to the first vertical direction. In another aspect of the invention, the plurality of adjoining panels includes at least one near panel having a proximal edge and a distal edge, and being in a plane at a positive angle relative to the first vertical direction, angled away from the respective lamp; at least one intermediate panel having a proximal edge at which the intermediate second planar panel extends from the at least one near panel, and a distal edge; and at least one distant panel having a proximal edge at which the distant panel extends from the distal edge of the at least one intermediate panel, and a distal edge, and being in a plane at a negative angle relative to the first vertical direction, angled toward the respective lamp. Typically, the panels are planar panels.

The present invention further relates to a light fixture including: a housing having an elongated axis in a horizontal plane, and including an elongated support means, the housing having first side edge and an opposed second side edge; an elongated reflector assembly, the reflector assembly comprising a proximal end affixed to the support means, a first extending reflector portion extending from the proximal end substantially in a first vertical direction perpendicular to the horizontal plane to a distal edge, the first extending reflector portion having a specular reflective surface that faces in a first horizontal direction, a second extending reflector portion extending from the proximal end in the first vertical direction to the distal edge, the second extending reflector portion having a specular reflective surface that faces in a second horizontal direction opposite the first horizontal direction; and first and second elongated lamps disposed proximate the support means, the first lamp disposed between the first extending reflector portion and the first side edge and the second lamp disposed between the second extending reflector portion and the second side edge, each lamp having electrically connectable to a socket means in electrical connection with an electrical power source; wherein the distal edge of the first and second extending reflector portions extend in the first vertical direction beyond the first and second lamps, whereby a portion of the light emitted by the first lamp in a second horizontal direction toward the first extending reflector portion is reflected in the first horizontal direction, and a portion of the light emitted by the second lamp in the first horizontal direction toward the second extending reflector portion is reflected in the second horizontal direction.

In an aspect of the invention, the elongated reflector assembly includes separate first and second elongated reflector elements, the first reflector element comprising a first proximal end affixed to the support means and the first extending reflector portion extending from the first proximal end, and the second reflector element comprising a second proximal end affixed to the support means and the second extending reflector portion extending from the second proximal end.

In another aspect of the invention, the housing also includes a perimeter sidewall positioned along at least the first and second side edges of the support means, and extending in the first vertical direction to a rim edge, and wherein at least a portion of each of the lamps extends in the first vertical direction beyond the rim edge.

In another aspect of the invention, the light fixture provides that all light emitted from the lamp at an angle of at least about 45 degrees from the first vertical distance toward the disposed reflector assembly, is reflected by the extending reflector portion in the opposed horizontal direction.

In another aspect of the invention, the vertically extending reflector portion includes a plurality of adjoining panels, wherein each of the plurality of adjoining panels is positioned in a plane at an angle relative to the vertical direction.

In another aspect of the invention, the light fixture further includes a domed lens positioned over and containing the extending reflector portions and the elongated lamps. The lens is preferably detachably secured to a portion of the housing. The lens in one aspect helps to protect the lamp from the environment, and in another aspect, can be configured with optical features which can bend and refract the light emitted from the lamp and reflected by the reflector assembly.

BRIEF DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
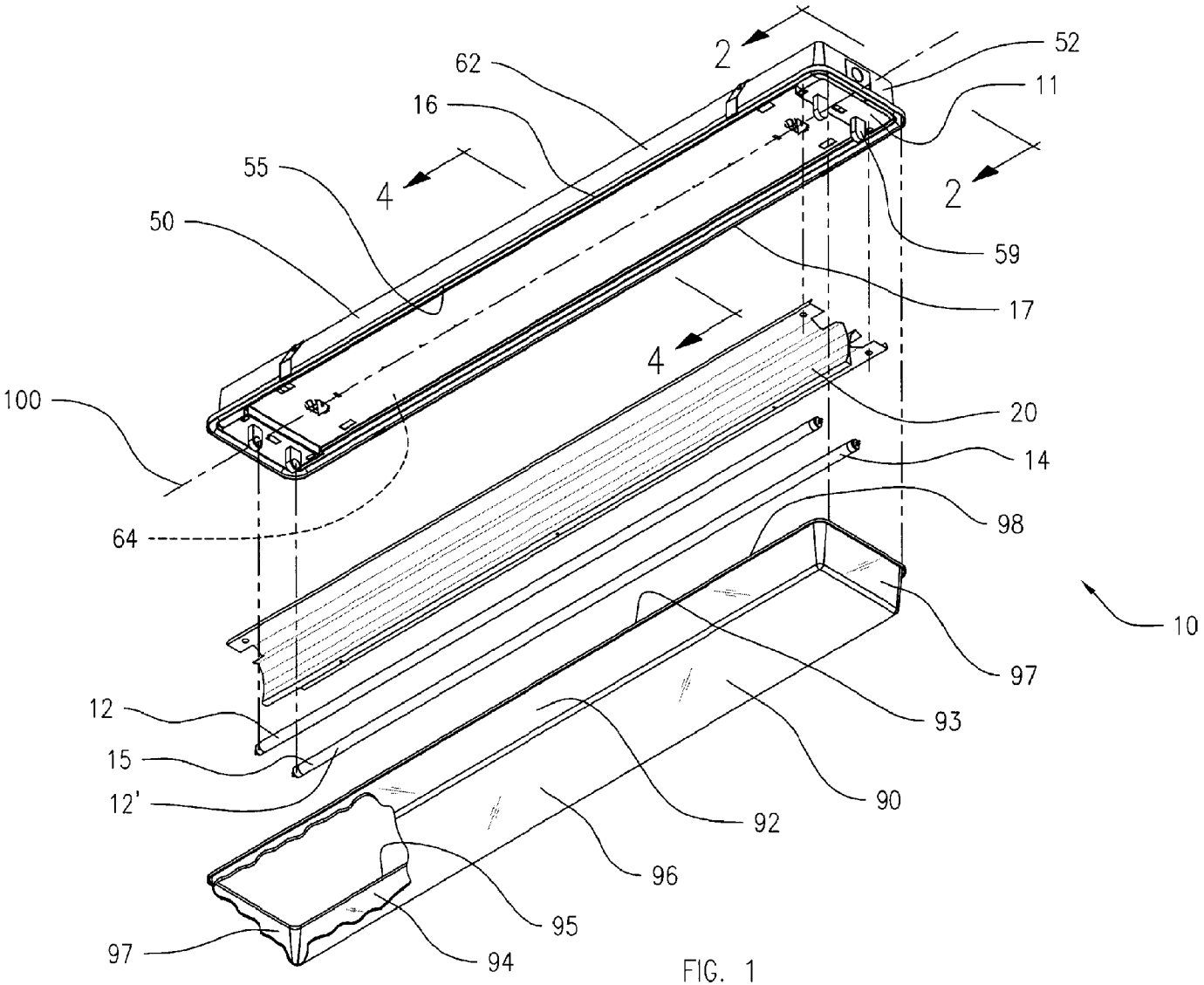
FIG. 1 is a bottom perspective and exploded view of one embodiment of the light fixture of the present invention, with a partial cut-away of the covering lens.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used.

As used herein, the direction or orientation "horizontal" is intended to mean a direction or orientation along the longitudinal axis of the elongated lamp, while the direction or orientation "vertical" is intended to mean a direction or orientation perpendicular to the longitudinal axis of the longitudinal lamp.

As described herein, light or a portion thereof that is emitted or reflected in a horizontal direction can include light that is emitted or reflected in a direction at an angle to the horizontal direction, and having a horizontal directional vector and a vertical directional vector.

As used herein, the term "nadir" is typically a direction from a light source toward the center of earth, and perpendicular to the horizon. When the lamp of the light fixture is disposed in a horizontal plane relative to earth, nadir is the downward vertical direction.

In a typical parking lot or parking garage application, there is a linear roadway and a plurality of parking spaces on either or both sides of the roadway, each parking space being approximately rectangular in shape and oriented with its length perpendicular to or at a slight angle to the direction of the roadway. The light fixture of the present invention is typically disposed on the ceiling or on a support above the roadway with its longitudinal axis disposed in the direction of the roadway, whereby the laterally emitted and reflected light extends toward the parking spaces.

An embodiment is now described with reference to the figures, in which like reference characters indicate like parts throughout the several views.

Referring to FIGS. 1-4, a light fixture 10 or troffer of the present invention for illuminating an area includes a support means, illustrated as a support pan 11, a reflector assembly 20, and one or more linear light source 12 and 12'. The light source extends along a light longitudinal axis 100 between a first end 14 of the light source and a spaced second end 15 thereof. The fixture 10 also has a first side edge 16 and an opposite second side edge 17. Light emanating from the light source 12 and reflected by the reflector assembly passes through a lens assembly 90 that is positioned between the light source 12 and the area to be illuminated. The light source 12 may be a conventional fluorescent lamp, such as a type T5, T8 or T12.

The reflector assembly 20 includes a pair of elongated reflector elements 22,22'. At least a portion of each reflector element 22 forms a reflective surface. In one aspect, at least a portion of the reflector element 22 can be painted or coated with a reflective material or formed from a reflective material. The reflective material may be substantially glossy or substantially flat. In one example, the reflective material is mirror-finished reflective aluminum to efficiently reflect incident light, and typically is Miro-4 (95% minimum reflectivity) available from Alanod Aluminum—Veredlung GMBH & Co. KG.

Figure 4:
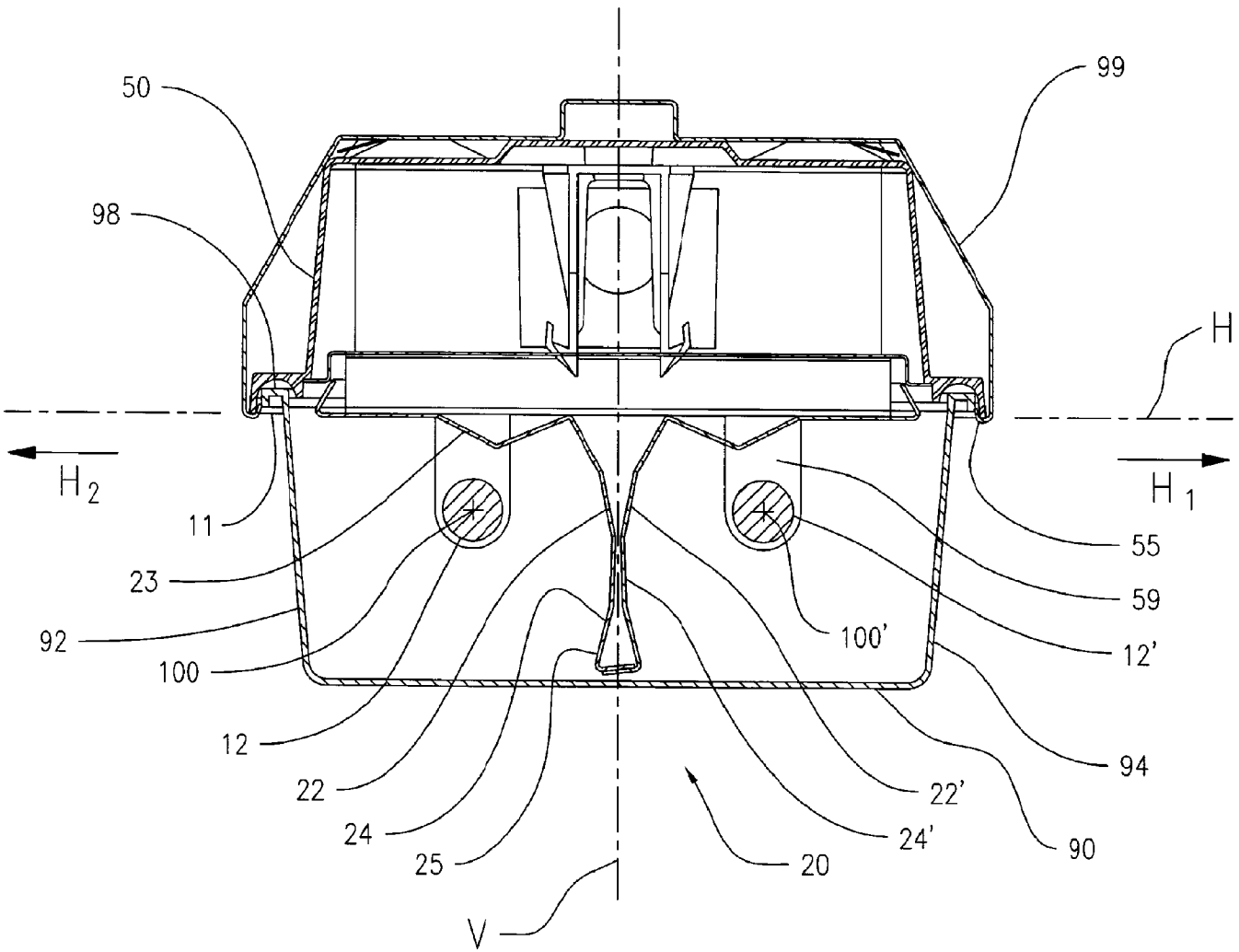
FIG. 4 is a sectional elevation view of the light fixture taken along line 4-4 of FIG. 1.

Each reflector element 22 includes a proximal portion shown as a base reflector 23 that is affixed to the housing proximate the support pan 11, and an extending reflector 24 that extends from the base reflector 23 to a distal edge 25. The two reflector elements 22 and 22' can be either temporarily or permanently attached together to form the reflector assembly. The distal ends 25 of each reflector element 22,22' are shown overlapped one on the other, which ends can be secured together with conventional attachment or fixture means, such as a screw, threaded nut and bolt, latch, a catch, a weld or adhesive. The reflector element 22, including the base reflector 23 and extending reflector 24 portions, are elongated and commensurate with the elongated light source 12. The extending reflector 24 extends substantially in a vertical direction (as shown in FIG. 4, when the support pan 11 of the light fixture lies in a horizontal plane), substantially normal to the base reflector 23. The extending reflector 24 is shown integral with the base reflector 23, but can also be a separate, attachable element.

Figure 5:
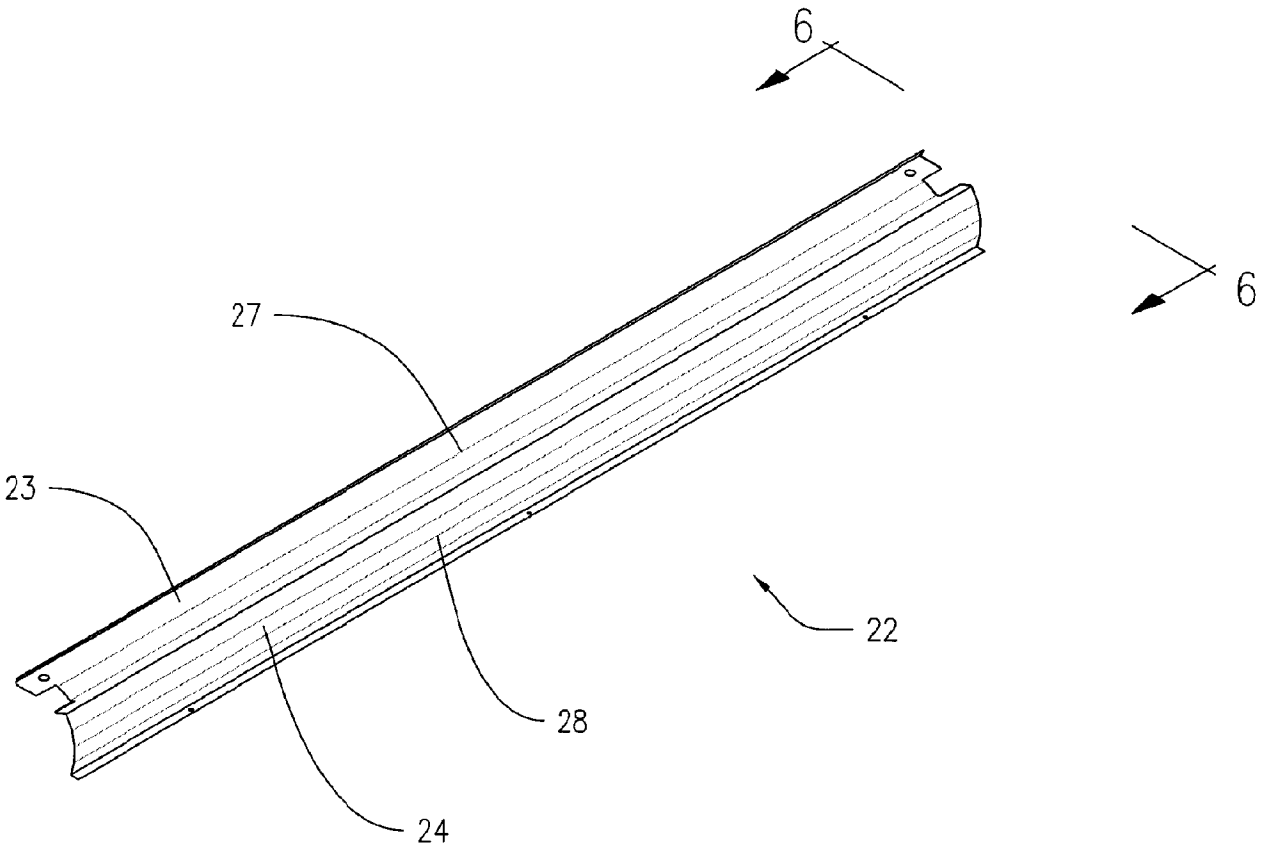
FIG. 5 is a perspective view of the reflector element used in the light fixture of FIG. 1.
Figure 6:
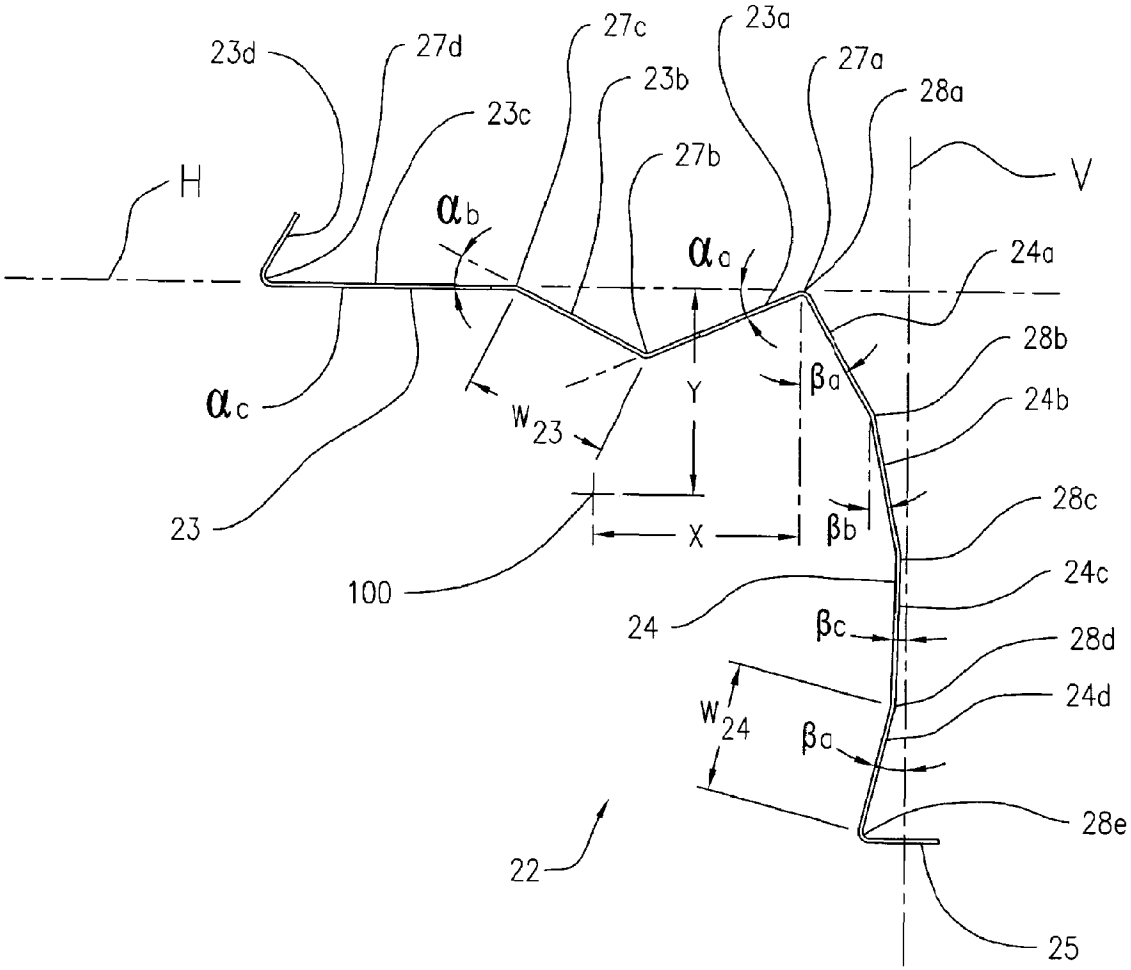
FIG. 6 is an end elevation view of the reflector element viewed from line 6-6 of FIG. 5.

As shown in greater detail in FIGS. 5 and 6, the base reflector 23 can be formed having a plurality (numbered "m") of adjacent elongated panels 23*a*, 23*b*, etc., along elongated folds 27, where m is greater than 1 and typically equals 2-10, though more than 10 panels can be used. Each panel $\mathbf{23}_m$ lies in a plane disposed at an angle $\alpha$ at a proximal edge from the horizontal plane (line H) through support pan 11. Thus, panel 23*a* lies in plane through its proximal edge at fold line 27*a* at an angle $\alpha_a$ relative to plane H; panel 23*b* lies in plane through its proximal edge at fold line 27*b* at an angle $\alpha_b$ relative to plane H; and panel 23*c* lies in plane through its proximal edge at fold line 27*c* at an angle $\alpha_c$ relative to plane H. The angle $\alpha_m$ is deemed a positive angle when the elongated panel angles from its proximal edge away from the lamp 12 (centerline 100), and a negative angle when the elongated panel angles from its proximal edge toward the lamp.

In the illustrated embodiment, $\alpha_a$ is about −20° to −26°, $\alpha_b$ is about +24° to about +30°, and $\alpha_c$ is about −3° to about +3°. The panels $\mathbf{23}_m$ are typically planar. When the panels have a curvilinear cross section in a vertical plane, a tangent light to the curved surface has the respective angles $\alpha$. The reflecting function of each base reflector panel 23*m* is affected by its disposed angle $\alpha$ and its respective width "$w_{23}$", shown in FIG. 6, as well as its position relative to the elongated lamp. For orientation purposes, the position 27*a*, representing the proximal end of the extending reflector portion 24, is shown disposed by distances x and y from the centerline 100 of the elongated lamp. Distal base panel 23*d* can have any length (width) and configuration useful for its securement to the support pan 11 or housing 50.

The extending reflector 24 can be formed having a plurality (numbered "n") of adjacent elongated panels 24*a*, 24*b*, etc., along elongated folds 28, where n is greater than 2 and typically equals 2-10, though more than 10 panels can be used. Each panel $\mathbf{24}_n$ lies in a plane disposed at an angle $\beta$ at a proximal edge from a vertical plane (line V) perpendicular to the lamp axis 100. Thus, panel 24*a* lies in a plane through its proximal edge at fold line 28*a* at an angle $\beta_a$ relative to vertical line V; panel 24*b* lies in plane through its proximal edge at fold line 28*b* at an angle $\beta_b$ relative to line V; etc. The angle $\beta_m$ is deemed a positive angle when the elongated panel angles from its proximal edge away from the lamp, and a negative angle when the elongated panel angles from its proximal edge toward the lamp.

In the illustrated embodiment, $\beta_a$ is about +27° to about +33°, $\beta_b$ is about +8° to about +14°, $\beta_b$ is about +1° to about −5°, and $\beta_d$ is about −11° to about −17°. The panels $\mathbf{24}_n$ are typically planar, though they can have a curvilinear cross section in a vertical plane. The reflecting function of each extending reflector panel 24*n* is affected by its disposed angle $\beta$ and its respective width "$w_{24}$", shown in FIG. 6, as well as its position relative to the elongated lamp. Distal edge panel 25 can have any width and be disposed at any angle useful for its securement in the fixture.

Table A shows the angles $\alpha$ and $\beta$, widths w, and dimensions x and y of the base reflector panel and the extending reflector panel for a typical reflector element of the present invention.

In another aspect of the invention, one or more extending reflector panels $\mathbf{24}_n$ extend vertically beyond (below) the lamp 12. In another aspect of the invention, at least one of the one or more extending reflector panels is angled toward the lamp with an angle 131.

The base reflector 23 and the extending reflector 24, and the panels thereof, can be formed from a single piece of material or from a plurality of adjoined pieces. As one will appreciate, the reflector assembly can be formed from any code-compliant material. For example, the reflector can be formed from steel, aluminum, or metallized formed plastic, including extruded plastic.

The base reflectors 23 and extending reflectors 24 are secured in position to the support pan 11 to avoid accidental and incidental movement or rotation of panels out of the preselected position and orientation that is determined to reflect light emitted from the positioned and secured light source 12 to a predetermined location below and laterally spaced from the light fixture.

Figure 7:
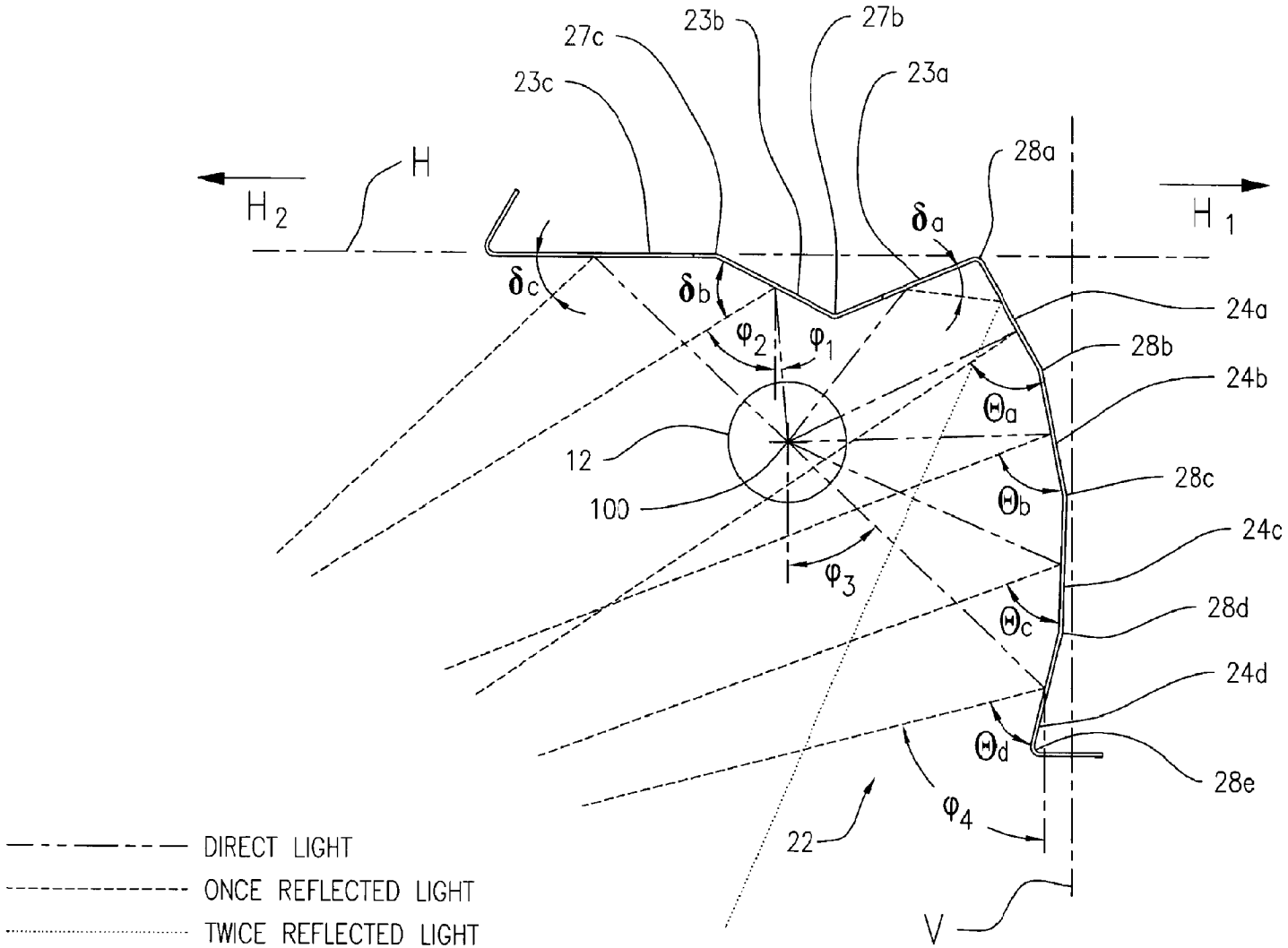
FIG. 7 is the end elevation view of the reflector element of FIG. 6, which also shows its position relative to the lamp.

Each panel $23_m$ of the base reflector 23 and panel $24_n$ of the extending reflector 24 reflects the light that is emitted by the light source at respective incident angles relative to the centerline 100 of the elongated light source 12. As shown in FIG. 7, each base reflector panel 23*a*, 23*b*, and 23*c* is disposed distance wise and angularly relative to the centerline 100 of the light source 12, wherein light from the light source 12 (depicted as emitting from centerline 100) strikes the plane of the panel $23_m$ at an incidence angle δ. Thus, panel 23*a* receives light emitted from the light source 12 at an incidence angle $\delta_a$, and reflects the light at equivalent reflectance angle $\delta_a$; panel 23*b* receives light emitted from the light source 12 at an incidence angle $\delta_b$, and reflects the light at equivalent reflectance angle $\delta_b$; and panel 23*c* receives light emitted from the light source 12 at an incidence angle $\delta_c$, and reflects the light at equivalent reflectance angle $\delta_c$.

Each extending reflector panel 24*a*, 24*b*, 24*c* and 24*d* likewise is disposed distance wise and angularly relative to the centerline 100 of the light source 12, wherein light from the light source 12 strikes the plane of the panel $24_n$ at an incidence angle θ. Thus, panel 24*a* receives light emitted from the light source 12 at an incidence angle $\theta_a$, and reflects the light at equivalent reflectance angle $\theta_a$; panel 24*b* receives light emitted from the light source 12 at an incidence angle $\theta_b$, and reflects the light at equivalent reflectance angle $\theta_b$; panel 24*c* receives light emitted from the light source 12 at incidence angle $\theta_c$, and reflects the light at equivalent reflectance angle $\theta_c$; and panel 24*d* receives light emitted from the light source 12 at an incidence angle $\theta_d$, and reflects the light at equivalent reflectance angle $\theta_d$. It can also be understood that the light received at different positions along the width w of a planar panel strikes and reflects at different incidence and reflectance angles.

The positioning of the lamp 12 in relation to each of the panels 23 and 24 of the reflector element 22 provides capture and control of the light to ward areas below and laterally away from the light fixture 10 where lighting is desired. In the illustrated embodiment, a portion of the light emitted upward toward the housing is reflected off of the first and second base reflector panels 23*a* and 23*b* and directed to areas below and laterally away from the light fixture. The light emitted toward the second base reflector 23*b* is received at a first angle ϕ1 from vertical (V), and is reflected at a second opposing angle ϕ2 from vertical that is greater than ϕ1. Another portion of the light emitted upward toward the housing is reflected off of the first base reflector panel 23*a* and further reflects off of one of the vertical reflector panels (illustrated as the first extending reflector panel 24*a*) and to an area below the light fixture.

Figure 2:
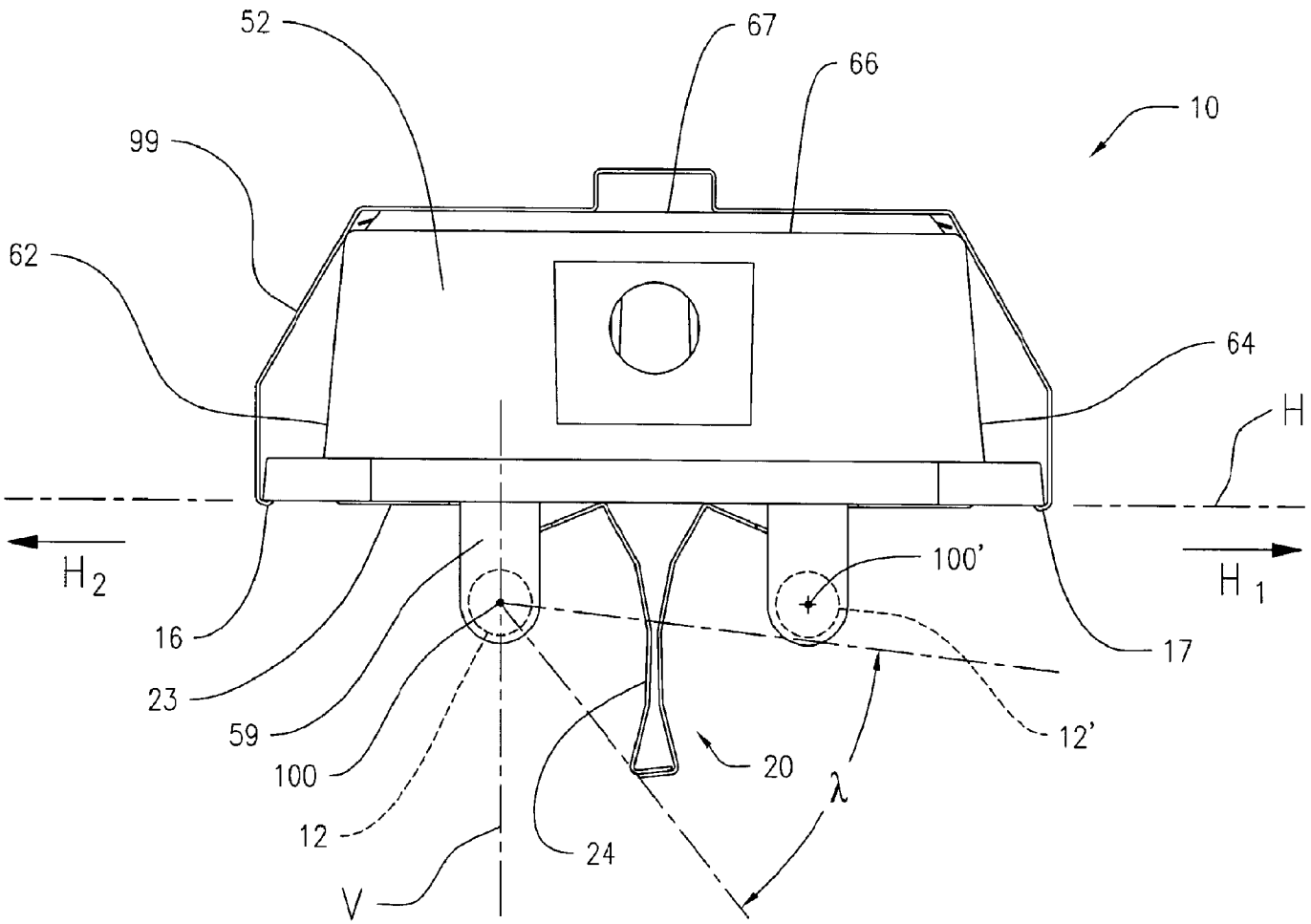
FIG. 2 is an end elevation view of the assembled light fixture viewed from line 2-2 of FIG. 1, with the covering lens removed.

The light fixture is configured to reflect a majority of the light that is emitted by one lamp 12 at the opposed second lamp 12', toward the opposite horizontal direction and away from the fixture to an area where lighting is needed, and typically laterally below and away from the fixture. As shown in FIG. 2, all light emitted from the lamp 12 at an angle λ of at least about 45 degrees from the first vertical direction V, toward the extending reflector portion 24 (in the $H_1$ direction), is reflected by the extending reflector portion 24. In can be seen that light emitted from the lamp 12 in the angular range λ would otherwise alight onto the area below and laterally in the same direction away from the fixture, but for its reflection by the extending reflector portion 24. It can be seen that the effect of the extending reflector 24 is to reflect the light emitted in an angular range λ in a controlled manner to an area more laterally distant from the light fixture 10. A portion of the emitted light in the angular range λ is reflected off of the extending reflector panels 24*b*, 24*c* and 24*d* in the opposite horizontal direction $H_2$.

FIG. 7 shows one or more extending reflector panels, such as reflector panels 24*c* and 24*d*, positioned to extending vertically below and angled toward the lamp. This positioning of the reflector panels reflects the light emitted from the lamp in a first horizontal direction $H_1$ at a first angle ϕ3 from vertical (V) toward the second opposite horizontal direction $H_2$ at an angle ϕ4 from vertical that is greater than ϕ3. Thus, the reflector throws light toward areas more laterally remote from the fixture.

Light emitted by the second light source 12' can be similarly reflected by the second reflector element 22'.

One can envision a conventional dual lamp fixture without a reflector assembly, in which light emitted by the lamp at the second lamp is substantially absorbed by the second lamp, or is diffusely scattered. In contrast, the present invention also provides a fixture wherein light emitted by the first light source 12 in a generally first horizontal direction at or toward the second lamp source 12' reflects off of the extending reflector 24 and toward the opposite horizontal direction $H_2$. Light that would otherwise be wasted by striking and diffusing off of the adjacent lamp is captured and directed as usable light by the extending reflector panels in the generally opposite horizontal direction.

Figure 3:
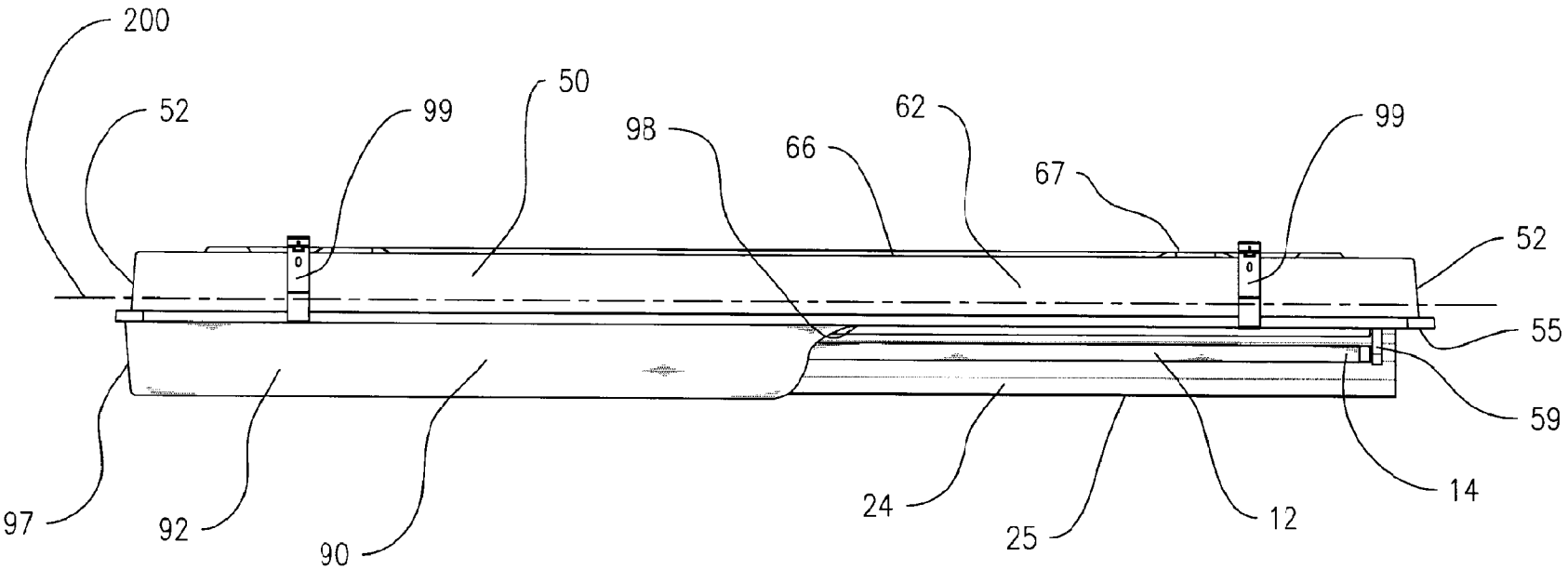
FIG. 3 is a side elevation view of the light fixture shown in FIG. 1.

As shown in FIGS. 1-3, the light fixture 10 typically has an external housing 50 and a support means, illustrated as a support pan 11, associated within an inner surface of the housing. The housing has an outer surface having opposed first and second end faces 52, and a first side wall 62 and a second side wall 64 on opposed first and second end edges of the support pan 11. The first and second end faces 52 and the first 62 and second 64 side walls cooperate with an upper mounting surface 66 to define an enclosed volume within the light fixture. The support pan 11 supports and secures the lamp sockets, reflector, and ballasts within the housing. Each of the end faces and side walls extends downwardly away from and along the edges of the support pan 11 toward a common bottom edge 55 of the housing. Each of the first and second end faces 52 and each of the first and second side walls 62, 64 may be substantially planar or non-planar. In the non-planar embodiments, portions of the first and second end faces and the first and second side walls are curved. The curved portions of the first and second end faces can be substantially concave or substantially convex. In one aspect, at least a portion of the lamp 12 extends in the first vertical direction beyond the bottom edge 55 of the housing.

The support pan 11 is typically affixed to the housing 50 with conventional attachment means, such as screws, bolts and nuts, latches, catches, etc. The reflector assembly 20 is positioned relative to and attached, typically removably attached, to the support pan 11 by convention attachment means, such as screws, bolts and nuts, latches, catches, and others. Removal of the reflector assembly 20 may be needed to replace a faulty ballast or other component, or to reposition the reflector assembly to improve its performance or to achieve a different lighting effect.

Another embodiment of the invention provides a light fixture having a single lamp light with an extending reflector disposed on one side of the lamp horizontally disposed from the single lamp. Light reflecting off of the panels 24*n* of the extending reflector 24 is directed to an area below and to the horizontal direction opposite from the lamp.

In an aspect of the invention, the light fixture 10 is constructed and arranged to mount an electrical socket 59 or receptacle for detachably securing a selected end of the light source thereto. In one example, the electrical socket 59 is mounted onto a portion of the support pan 11 or its associated structure.

The light fixture 10 also includes at least one conventional light ballast (not shown) constructed and arranged for electrically connecting the light source to an external power source. In one aspect, the at least one ballast is positioned within the interior of the enclosed volume, to a portion of the support means.

In one aspect, the light fixture is suspended from a ceiling. In the illustrated embodiment, the housing is spaced from the ceiling a predetermined distance and is mounted to the ceiling via conventional suspension means, including bolts securing a bracket 67 disposed on the mounting surface 66 to the ceiling.

Referring to FIG. 3, the lens 90 of the present invention is constructed and arranged to direct light emitted by the light source 12 and reflected from the reflector assembly 20 out to the areas to be illuminated. A basic function of the lens 90 is to protect the mounted light sources 12 and the extending reflector element from obstructions and the elements.

As shown in FIG. 1, in one aspect, the lens 90 includes a first side face 92 having a first side edge 93, an opposed second side face 94 having a second side edge 95, and a central face 96 extending between the first side face 92 and the second side face 94. The lens 90 typically has opposed side faces 97 which enclose the volume between the first and second end faces 92, 94, with an opening defined by a housing-engaging rim 98 including the first and second end edges 93, 95 and the edges of the first and second end faces 92, 94. The lens has a lens longitudinal axis 200 that extends between the first and second end faces 97, and is generally parallel to the light source longitudinal axis 100. The rim 98 engages the outer peripheral edge 55 of the housing, such that the light sources 12 and 12' and the extending reflectors 24 are positioned within the volume of the lens, as shown in FIG. 4.

The lens 90 can be made from any suitable, code-compliant material such as, for example, a polymer or plastic. For example, the lens 90 can be constructed by extruding pellets of meth-acrylate or polycarbonates into the desired shape of the lens. The lens 90 can be of a clear material or a translucent material. In another aspect, the lens can be colored or tinted.

The lens 90 is constructed and arranged for detachable connection to the light fixture 10. The lens can be secured to the light fixture by any well known means, such as clamps, straps, slots and t-bolts, threaded bores and screws. FIG. 3 shows a plurality of clamps 99 having a fixed end secured to the housing and a hooked free end that engages a slot, latch or other engagement means disposed on the end faces 92, 94, to secure the rim 98 of the lens 90 to the housing. The lens assembly 90 can also include a conventional diffuser inlay, such as, for example, a OptiGrafix™ film product, which is a diffuser film that can be purchased from Grafix Plastics, a division of Graphic Art Systems, Inc. of Cleveland, Ohio. The diffuser inlay can be pliable or fixed in shape, transparent, semi-translucent, translucent, and/or colored or tinted.

The use of the reflector assembly of the present invention in fluorescent light fixtures can provide a number of advantages, including improved lighting, increased lighting in areas laterally, and longitudinally, remote from the fixture, the opportunity to use a lamp of lower wattage requirements, resulting in an energy savings in an existing light fixture arrangement; and an improvement in the positioning and lighting, with fewer lighting fixtures and reduced energy consumption, in new lighting applications.

Representative Embodiment of the Invention

A representative embodiment of the invention has a housing, lens and reflector assembly substantially as shown in FIGS. 1-7, denoted EG-30, with two pairs of sockets for supporting a pair of 54 watt, 4-foot T5HO lamps. The shape and orientation of the reflector assemblies are shown in Table A-1. The light output of the embodiment mounted at 8 feet above ground level is compared with a conventional light fixture that is the same in every aspect, with the same two powered lamps, with a conventional planar, reflector pan in place of the reflector assembly, and likewise mounted at 8 feet above ground level.

Figure 8A:
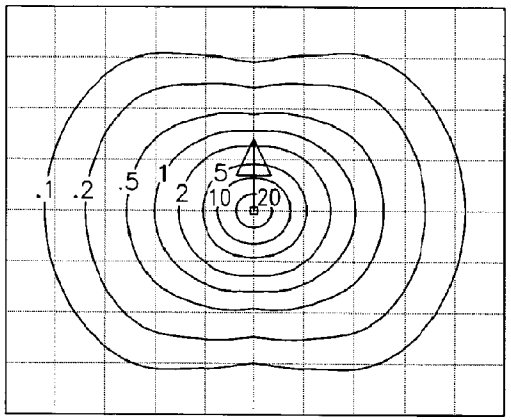
FIG. 8A shows a light distribution pattern for a conventional 2-lamp light fixture, at an 8-foot mounting height.
Figure 8B:
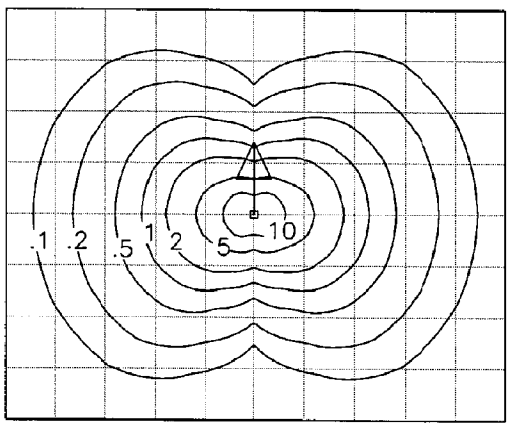
FIG. 8B shows a light distribution pattern for a similarly configured light fixture of the present invention that includes the reflector assembly, at the 8-foot mounting height.
Figure 8C:
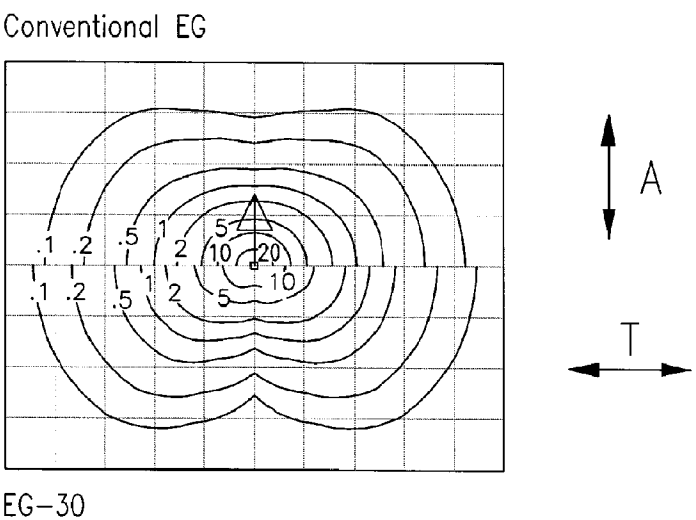
FIG. 8C shows a side-by-side comparison of the light distribution pattern for the conventional 2-lamp light fixture of FIG. 8A (top panel) and for the light fixture of the present invention of FIG. 8B (bottom panel).

The test results for the conventional light fixture ("conventional EG") and for the representative light fixture of the present invention ("EG-30") are included in FIGS. 8A and 8B, respectively, with a side-by-side (actually, top and bottom) comparison shown in FIG. 8C, with the conventional light fixture ("conventional EG") shown in the top half and the representative light fixture of the present invention shown in the bottom half. EG stands for "enclosed and gasketed". The triangular emblem in the figures shows the direction of traffic in the parking garage. The comparison shows that the representative light fixture provides more light than the conventional light fixture, below the fixture and toward areas both to the sides (axially from the lamps, in the A direction) and laterally (transverse to the axis of the lamp, in the T direction) remote from the light fixture.

Although several embodiments of the invention have been disclosed in the foregoing specification, it is understood by those skilled in the art that the invention is not limited to the specific embodiments disclosed hereinabove, and that modifications and other embodiments and are intended are included within the scope of the appended claims.

TABLE A

Angles and dimensions of reflector panels

| Parameter | EG-30 embodiment |
|---|---|
| x | 0.987 inches (25.07 mm) |
| y | 0.938 inches (23.83 mm) |
| $\alpha_a$ | (−) 23° |
| $\alpha_b$ | (+) 27° |
| $\alpha_c$ | 0° |
| $\beta_a$ | (+) 30° |
| $\beta_b$ | (+) 11° |
| $\beta_c$ | (−) 2° |
| $\beta_d$ | (−) 14° |
| $w_{23}a$ | 0.80 inches (20.3 mm) |
| $w_{23}b$ | 0.69 inches (17.5 mm) |
| $w_{23}c$ | 1.22 inches (31 mm) |
| $w_{24}a$ | 0.66 inches (16.8 mm) |
| $w_{24}b$ | 0.67 inches (17.0 mm) |
| $w_{24}c$ | 0.69 inches (17.5 mm) |
| $w_{24}d$ | 0.64 inches (16.3 mm) |

I claim:

1. A light fixture including:

a housing having an elongated axis in a horizontal plane and an elongated support having at least one side edge;

an elongated reflector element having a proximal end affixed to the elongated support, an extending reflector portion extending from the proximal end in a first vertical direction normal to the horizontal plane to a distal edge and having at least one specular reflective surface;

a socket means in electrical connection with an electrical power source; and an elongated lamp that emits light, having a longitudinal axis in the horizontal plane, wherein the lamp is connected to the socket means vertically below the proximal end of the elongated reflector, the distal edge of the extending reflector portion extends vertically beyond the lamp, and the lamp is disposed proximate the support between the extending reflector portion and the at least one side edge, wherein the at least one specular reflective surface of the reflector element receives a portion of the light that is emitted in a first horizontal direction at an emitted angle from a vertical direction, and reflects the portion of light in an opposite second horizontal direction, away from the light fixture, and at a reflected angle from vertical that is greater than the emitted angle, and toward an area more remote from the light fixture.

2. The light fixture according to claim 1 wherein the extending reflector portion includes a distal panel proximate the distal edge of the extending reflector portion, which is orientated at a negative angle from vertical towards the lamp.

3. The light fixture according to claim 1 wherein the light emitted by the lamp in the second horizontal direction is not reflected.

4. The light fixture according to claim 1 wherein the reflector element includes a base reflector affixed to the housing, which receives a portion of the light that is emitted at the housing in a generally vertical direction at an emitted angle from vertical, and reflects the portion of light in a horizontal direction at a reflected angle from vertical that is greater than the emitted angle, toward an area laterally remote from the fixture.

5. The light fixture according to claim 4 wherein the light emitted by the lamp in the second horizontal direction is not reflected.

6. The light fixture according to claim 1 further comprising a second reflector element and a second lamp that emits light having a longitudinal axis in a horizontal plane, wherein the first and second reflector elements are associated to form a reflector assembly, wherein the second reflector element receives a portion of the light that is emitted in a second horizontal direction at an emitted angle from the vertical direction, and to reflect the portion of light in an opposite first horizontal direction, away from the light fixture, and at a reflected angle from vertical that is greater than the emitted angle, and toward an area more remote from the light fixture and wherein the extending reflector portion of the first and second reflector elements are is disposed between the two lamps.

7. The light fixture according to claim 6 wherein the light emitted by the lamp in the second horizontal direction is not reflected.

8. The light fixture according to claim 1 wherein the extending reflector portion includes a plurality of adjoining, elongated panels, joined along one or more fold lines, wherein each of the plurality of adjoining panels is positioned in a plane at an angle relative to vertical.

9. The light fixture according to claim 8 wherein the plurality of adjoining, elongated panels includes at least one near planar panel having a proximal edge and a distal edge, and being in a plane at a positive angle relative to the first vertical direction, angled away from the respective lamp; at least one intermediate planar panel having a proximal edge at which the intermediate second planar panel extends from the first planar panel, and a distal edge; and at least one distant planar panel having a proximal edge at which the distant planar panel extends from the distal edge of the intermediate second planar panel, and a distal edge, and being in a plane at a negative angle relative to the first vertical direction, angled toward the respective lamp.

10. A light fixture including:

a housing having an elongated axis in a horizontal plane, and including an elongated support means, the housing having first side edge and an opposed second side edge;

an elongated reflector assembly, the reflector assembly comprising a proximal end affixed to the support means, a first extending reflector portion extending from the proximal end substantially in a first vertical direction perpendicular to the horizontal plane to a distal edge, the first extending reflector portion having a specular reflective surface that faces in a first horizontal direction, a second extending reflector portion extending from the proximal end in the first vertical direction to the distal edge, the second extending reflector portion having a specular reflective surface that faces in a second horizontal direction opposite the first horizontal direction; and a first and second pair of electrical sockets mounted to the light fixture to detachably secure elongated lamps proximate the support means along a first and second axis, the first axis disposed between the specular reflective surface of the first extending reflector portion and the first side edge and vertically below the proximal end of the reflector assembly, and the second axis disposed between the specular reflective surface of the second extending reflector portion and the second side edge and vertically below the proximal end of the reflector assembly, each pair of electrical sockets being electrically connected with an electrical power source;

wherein the distal edge of the first and second extending reflector portions extend in the first vertical direction beyond the first and second lamps, whereby a portion of the light emitted by a first lamp along the first axis in a second horizontal direction toward the first extending reflector portion is reflected in the first horizontal direction, and a portion of the light emitted by a second lamp along the second axis in the first horizontal direction toward the second extending reflector portion is reflected in the second horizontal direction wherein a portion of the distal edge of the first extending reflector extending vertically below the first axis is angled toward the first axis and a portion of the distal edge of the second extending reflector portion extending vertically below the second axis is angled toward the second axis.

11. The light fixture according to claim 10 wherein the elongated reflector assembly includes separate first and second elongated reflector elements, the first reflector element comprising a first proximal end affixed to the base and the first extending reflector portion extending from the first proximal end, and the second reflector element comprising a second proximal end affixed to the base and the second extending reflector portion extending from the second proximal end.

12. The light fixture according to claim 10 wherein the housing further includes first and second end faces, wherein the first and second end faces and first and second side edges form a perimeter sidewall that extends in the first vertical direction to a rim edge, and wherein each axis extends in the first vertical direction beyond the rim edge.

13. The light fixture according to claim 10 wherein all light emitted from each lamp positioned along the axis, at an angle of at least about 45 degrees from the first vertical direction toward the respective extending reflector portions, is reflected by the extending reflector portion.

14. The light fixture according to claim 10 wherein the extending reflector portion includes a plurality of adjoining panels, wherein each of the plurality of adjoining panels is positioned in a plane at an angle relative to the first vertical direction.

15. The light fixture according to claim 10 wherein the light fixture further includes a domed lens positioned over and containing the extending reflector portions and the elongated lamps.

16. A light fixture including:

a housing having an elongated axis in a horizontal plane, the housing including an elongated support means having at least one side edge;

an elongated reflector element having a proximal end affixed to the support means, an extending reflector portion extending from the proximal end in a first vertical direction normal to the horizontal plane to a distal edge, the extending reflector portion having at least one specular reflective surface, and having a plurality of adjoining, elongated panels, including at least one near planar panel having a proximal edge and a distal edge, and being in a plane at a positive angle relative to the first vertical direction, angled away from the respective lamp, at least one intermediate planar panel having a proximal edge at which the intermediate second planar panel extends from the first planar panel, and a distal edge, and at least one distant planar panel having a proximal edge at which the distant planar panel extends from the distal edge of the intermediate second planar panel, and a distal edge, and being in a plane at a negative angle relative to the first vertical direction, angled toward the respective lamp;

an elongated lamp disposed proximate the support means between the extending reflector portion and the at least one side edge, the lamp connectable to a socket means in electrical connection with an electrical power source; and wherein the distal edge of the extending reflector portion extends vertically beyond the lamp, whereby a portion of the light emitted by the lamp in a first horizontal direction toward the at least one specular reflective surface is reflected in an opposite second horizontal direction.

* * * * *